US008099912B2

(12) United States Patent
DeJonge et al.

(10) Patent No.: US 8,099,912 B2
(45) Date of Patent: Jan. 24, 2012

(54) UNIVERSAL FLOOR PANEL FOR RAISED FLOORS

(75) Inventors: Mark O. DeJonge, Ada, MI (US); James F. Clifford, Byron Center, MI (US)

(73) Assignee: Opstock, Inc., Ada, MI (US)

( * ) Notice: Subject to any disclaimer, the term of this patent is extended or adjusted under 35 U.S.C. 154(b) by 0 days.

(21) Appl. No.: 12/916,965

(22) Filed: Nov. 1, 2010

(65) Prior Publication Data

US 2011/0041423 A1 Feb. 24, 2011

Related U.S. Application Data

(63) Continuation of application No. 11/744,341, filed on May 4, 2007, now Pat. No. 7,823,340.

(51) Int. Cl.
*E04B 5/48* (2006.01)

(52) U.S. Cl. ..... 52/126.2; 52/220.1; 52/302.3; 292/200

(58) Field of Classification Search ..... 52/126.2, 52/126.5, 263, 302.1, 661, 673, 220.1, 126.6, 52/302.3, 506.01, 19; 454/202, 289; 292/143, 292/173, 226, 200, 336.3, DIG. 30, DIG. 27, 292/DIG. 31; D8/313, 302, 331; 312/244, 312/332.1, 348.6; 361/679.59
See application file for complete search history.

(56) References Cited

U.S. PATENT DOCUMENTS 2,792,985 A 5/1957 Heiman
3,153,553 A * 10/1964 Sandor ..... 292/336.3
3,236,018 A 2/1966 Graham et al.
3,255,687 A 6/1966 Glaser
3,511,011 A 5/1970 Morgan, Jr.
4,258,516 A 3/1981 Mori et al.
4,268,077 A 5/1981 Bohleen et al.
4,319,520 A 3/1982 Lanting et al.
4,348,841 A 9/1982 Ueno et al.
4,399,741 A 8/1983 Zboralski
4,558,544 A 12/1985 Albrecht et al.
4,593,499 A * 6/1986 Kobayashi et al. ..... 52/126.6
4,606,156 A 8/1986 Sweers et al.
4,676,036 A 6/1987 Bessert
4,719,727 A 1/1988 Cooper et al.
4,729,292 A 3/1988 Marton
4,736,555 A 4/1988 Nagare et al.
4,745,715 A 5/1988 Hardwicke et al.
4,825,603 A 5/1989 Hardwicke et al.
4,856,256 A 8/1989 Tokuzo
D303,619 S * 9/1989 Russell et al. ..... D8/313
D306,350 S 2/1990 Hardwicke et al.
(Continued)

OTHER PUBLICATIONS www.triad-usfloors.com, pp. from website of Triad Access Floors Company.

(Continued)

*Primary Examiner* — Brian Glessner
*Assistant Examiner* — Adam Barlow
(74) *Attorney, Agent, or Firm* — Price Heneveld LLP

(57) ABSTRACT

An replacement floor panel is provided for a raised floor, and includes a top plate with corner-forming sections and leveling legs for height adjustment. Foot-print-expanding brackets engage the leveling legs for extending their foot print outwardly so that the floor panel can be used on different raised floor systems without misalignment problems with stanchion supports. A handle is pivotally mounted in the top plate between a flush position and a raised position for grasping to lift the replacement floor panel, the handle having a decor matching the top plate for aesthetics.

11 Claims, 6 Drawing Sheets

U.S. PATENT DOCUMENTS

| | | | | |
|---|---|---|---|---|
| 4,901,490 | A | | 2/1990 | Zinniel et al. |
| 4,914,881 | A | | 4/1990 | Spork |
| 4,924,760 | A | | 5/1990 | Jobson |
| 4,996,804 | A | | 3/1991 | Naka et al. |
| 5,052,156 | A | | 10/1991 | Tanaka et al. |
| 5,072,557 | A | * | 12/1991 | Naka et al. ..... 52/126.6 |
| D350,613 | S | | 9/1994 | Fahy, Jr. |
| 5,386,670 | A | | 2/1995 | Takeda et al. |
| 5,389,737 | A | * | 2/1995 | Kobayashi et al. ..... 174/483 |
| 5,402,617 | A | | 4/1995 | Daw et al. |
| 5,459,968 | A | | 10/1995 | Jin |
| 5,628,157 | A | | 5/1997 | Chen |
| 5,713,168 | A | | 2/1998 | Schilham |
| 6,101,768 | A | | 8/2000 | Springstead et al. |
| 6,256,952 | B1 | | 7/2001 | Fahy, Jr. et al. |
| 6,370,831 | B1 | | 4/2002 | Marshall et al. |
| D465,400 | S | * | 11/2002 | Moore et al. ..... D8/331 |
| 6,519,902 | B1 | * | 2/2003 | Scissom ..... 52/126.4 |
| 6,550,195 | B1 | | 4/2003 | Cooper et al. |
| 6,637,161 | B1 | | 10/2003 | Buchalter et al. |
| 6,748,707 | B1 | | 6/2004 | Buchalter et al. |
| 6,840,555 | B1 | | 1/2005 | Thompson |
| 6,918,217 | B2 | | 7/2005 | Jakob-Bamberg et al. |
| 6,983,570 | B2 | | 1/2006 | Mead |
| 7,052,053 | B2 | * | 5/2006 | Hall et al. ..... 292/126 |
| 7,360,343 | B1 | * | 4/2008 | Spransy et al. ..... 52/263 |
| 2002/0144477 | A1 | | 10/2002 | Chen |
| 2005/0050818 | A1 | | 3/2005 | Chen et al. |
| 2005/0193660 | A1 | | 9/2005 | Mead |
| 2005/0235589 | A1 | | 10/2005 | Jakob-Bamberg et al. |
| 2006/0248814 | A1 | | 11/2006 | Chen et al. |

OTHER PUBLICATIONS

ASM Modular Floors Catalog, Innovations in Access Flooring.
cTec Access Flooring Systems, CTec, Inc.
Computer Environments, Inc., Brochure.
Pati, Raised Access Floor System Brochure.
Aspmaxcess, Global Leaders in Intelligent Office Solutions, Raised Floor Guide.
Architectural Solutions, Pathways Floors & Wiring—Steelcase.
InterfaceAR, Product Profile: TecSteel Access Flooring.
InterfaceAR: Atlantic Access Floors.
Access Floors Product Guide: Access Floors to the Power of Tate.
InterfaceAR, Product Profile: TEcCrete Access Flooring.

* cited by examiner

UNIVERSAL FLOOR PANEL FOR RAISED FLOORS

CROSS-REFERENCE TO RELATED APPLICATION

This application is a continuation of U.S. patent application Ser. No. 11/744,341, issuing as U.S. Pat. No. 7,823,340, entitled AIR GRATE FOR RAISED FLOORS, by Mark O. DeJonge et al., filed May 4, 2007, the disclosure of which is hereby incorporated by reference in its entirety.

BACKGROUND

The present invention relates to a raised floor panel for a raised floor system such as for a computer room, the floor panels being adapted to mate with various existing systems.

Raised floor systems allow flexible installation and distribution of cabling and wires, and also allow air conditioning to be funneled under the floor and into the room through apertured panels (also called "air grates") at selected strategic locations in the room. Improvements are desired to allow replacement floor panels to mate with a wide variety of existing raised floor panel systems, so that the replacement panels don't have to be customized. Still further, improvement is desired to provide a flush handle, where the panels and their handles are sufficiently sturdy to support substantial weight, yet where the handle is not a trip hazard and is sturdy enough to allow the panel to be lifted and removed without special tooling. It is also desirable to provide a handle that blends into the design of the floor, and that does not result in an unsightly "blemish" in an otherwise visually attractive floor.

Thus, an apparatus and method having the aforementioned advantages and solving the aforementioned problems are desired.

SUMMARY OF THE PRESENT INVENTION

In one aspect of the present invention, a universal raised floor panel is provided that is configured and adapted for use with different raised floor systems having support stands with different floor-panel support surface configurations, but for use without misalignment problems with the respective support stands of the different raised floor systems. The floor panel includes a top plate adapted to form a part of a selected one of the different raised floor systems, the top plate including support structure for supporting weight on the top plate and including corners. The floor panel further includes corner-attached components at each of the corners including an adjustable leveling leg and bracket with horizontally-enlarged flange engaging the leveling leg. The corner-attached components are adapted and configured to support the floor panel on any one of the different raised floor systems by adjustably extending a foot print of the leveling leg at each one of the corners beyond a size of an end of the leveling leg but without direct attachment of the corner-attached components to any of the differently-shaped floor-panel-supporting support stands.

In another aspect of the present invention, a universal raised floor panel is configured and adapted for use with different raised floor systems having support stands with different floor-panel support surface configurations, where the floor panel includes a top plate and support structure for supporting weight on the top plate, the top plate including corner-forming sections that extend toward a perimeter of the top plate. The floor panel further includes leveling legs operably engaging the corner-forming sections for height adjustment, and foot-print-expanding brackets engaging the leveling legs for extending the foot print of the leveling legs nearer to outer edges of the top plate so that the floor panel can be used on different raised floor systems without misalignment problems caused by different support stands.

In another aspect of the present invention, a universal raised floor panel configured and adapted for use with different raised floor systems having support stands with different floor-panel support surface configurations, and includes a top plate and support structure for forming a part of a raised floor system, the support structure supporting the top plate for supporting weight on the top plate and a handle, where the top plate includes marginal material defining an opening shaped to receive the handle. The handle has a top plate section shaped to fit within the opening and is pivotable between a flush position where its upper surface aligns with an upper surface of the top plate so that at most a small gap exists around a perimeter of the top plate section, and a raised position where the handle can be grasp for lifting the floor panel.

In another aspect of the present invention, a universal raised floor panel configured and adapted for use with different raised floor systems having support stands with different floor-panel support surface configurations, and includes a top plate adapted to form part of a selected one of the different raised floor systems, the top plate including support structure for supporting weight on the top plate and including corners. The floor panel further includes corner-attached components at each of the corners, the corner-attached components being adjustable for vertical height adjustment and also including a bracket with a horizontally-enlarged flange adapted and configured to support the floor panel on any one of the different raised floor systems by extending a foot print of the corner-attached components at each one of the corners beyond a point location but without direct attachment of the corner-attached components to any of the differently-shaped floor-panel-supporting support stands.

These and other aspects, objects, and features of the present invention will be understood and appreciated by those skilled in the art upon studying the following specification, claims, and appended drawings.

DETAILED DESCRIPTION OF PREFERRED EMBODIMENTS

A replacement raised floor panel (illustrated as an air grate 20, see FIG. 1) is shown embodying the present invention. It is noted that specific dimensions are given to facilitate an understanding of the present invention, but that the present invention is not limited to only those dimensions, nor to only air grates.

Figure 1:
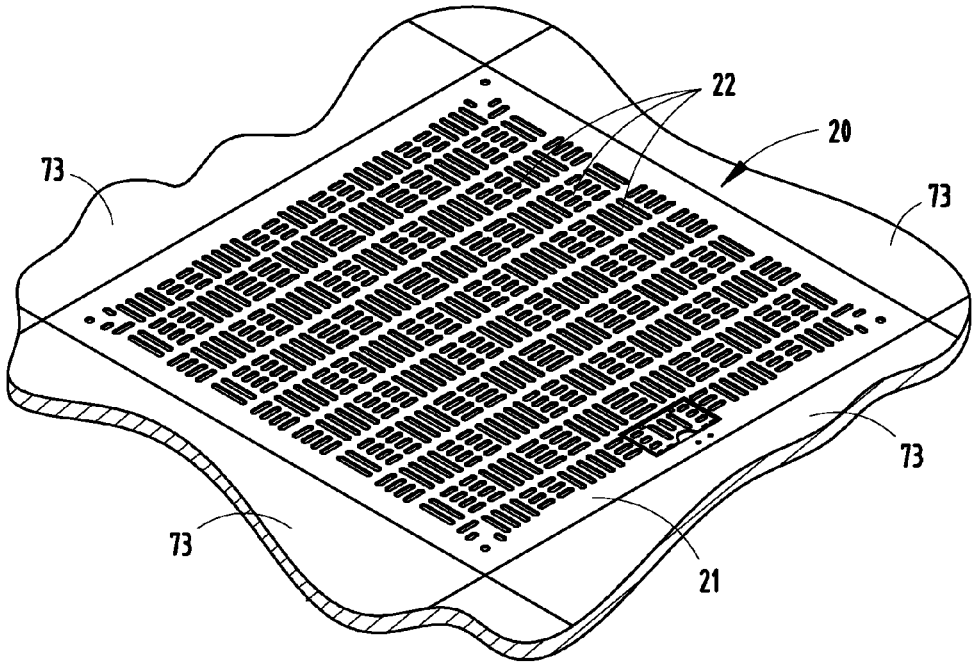
FIG. 1 is a perspective view of an air grate as part of a raised floor system.
Figure 2:
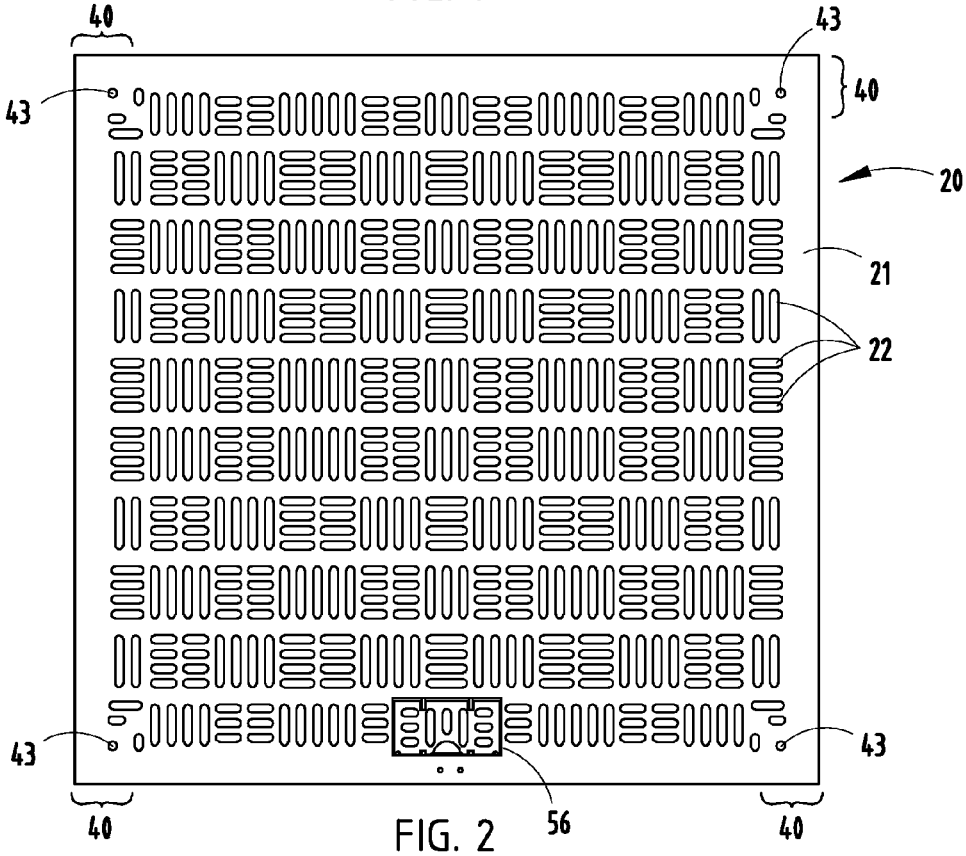
FIGS. 2-4 are top, bottom, and side views of the air grate of FIG. 1, FIG. 3 being a bottom view with dampener panels installed and FIG. 3A a similar view without dampener panels.
Figure 6:
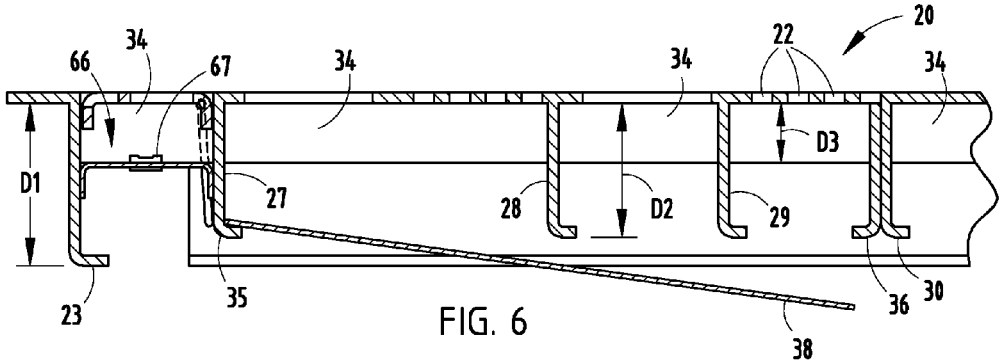
FIGS. 6-7 are side cross-sectional views showing installation of a dampener panel.

The present air grate 20 is configured for use in a raised floor system as shown in FIG. 1, and includes a top plate 21 with apertures 22 for air flow, and includes a matrix of interconnected reinforcement ribs for structural support. Notably, the density of apertures 22 can be increased or decreased depending on the particular requirements of an installation. The illustrated apertures 22 provide up to about 50% open area for air flow. The illustrated ribs include perimeter ribs 23-26 (FIG. 6) of a first dimension D1 (approximately 2 inches high) welded to top plate 21, first parallel ribs 27-33 of a shorter second dimension D2 (about 1½ inches high) welded to top plate 21, and shorter second transverse parallel ribs 34 of a third dimension D3 (about ⅝ inch high) welded between the ribs 23, 25, 27-33 and to the top plate 21 for strength. The ribs 27 and 30 include L-shaped bottom edge flanges 35 and 36 that extend toward each other to define the bottom of a horizontal track for receiving a flat dampener panel 38. The bottom surfaces of the ribs 28 and 29 form a top of the horizontal track for sliding engagement with the dampener panel 38. The ribs 30 and 33 include edge flanges (similar to flanges 35 and 36) to define a second horizontal track for dampener panels 38.

The illustrated dampener panels 38 are flat sheet metal components shaped to temporarily flex to slip between the edge flanges for assembly. However, it is contemplated that the dampener panels 38 can be made of other materials, such as plastic and other non-metal materials. The sheet metal is resilient such that it springs back to an original flat shape (i.e., it "unflexes"), such that its edges engage the track for adjustable movement along the track between different overlapping positions. This allows for very low cost assembly, allows the use of low cost components, and allows for adjustable controlled air flow. The illustrated dampener panels 38 include a single short slot, allowing top adjustment using a tool such as a screwdriver without removing the air grate 20 from the floor.

Figure 11A:
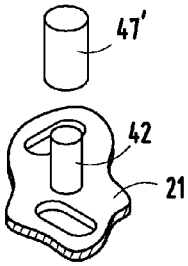
FIG. 11A is similar to FIG. 11 but illustrates an alternative design.
Figure 11:
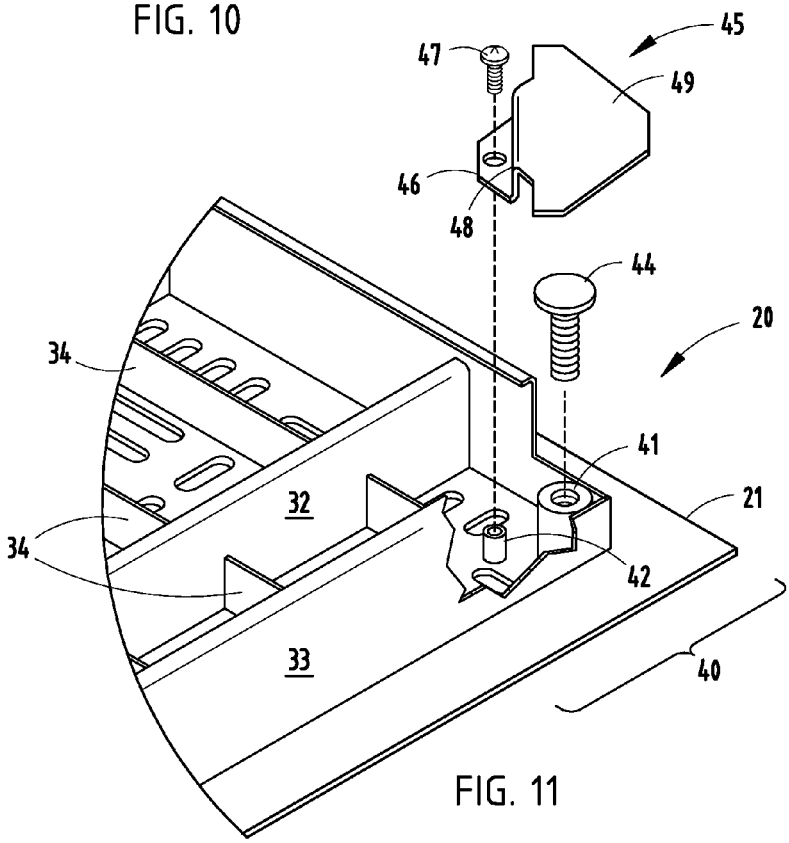
FIGS. 11-12 are a bottom exploded view and cross-sectional view of the corner arrangement of the present air grate including its leveling leg and Z-shaped corner bracket.
Figure 12:
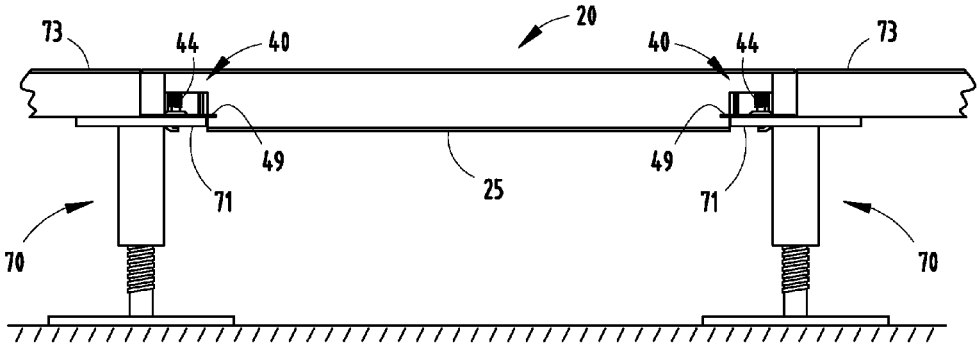
Figure 13:
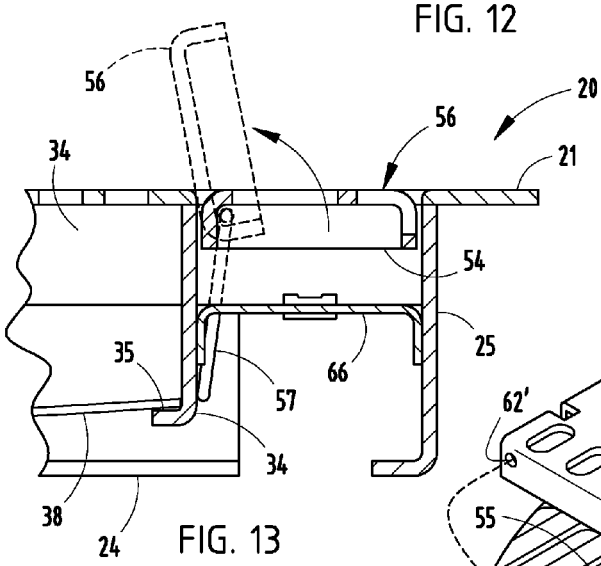
FIG. 13 is another cross-sectional view showing the present air grate and including its handle.

The top plate 21 of the air grate 20 includes corner-forming sections 40 (FIG. 11) that include first and second threaded bosses 41 and 42 attached to a bottom of each corner section 40. In the illustrated arrangement, the boss 41 is attached by welding, and the boss 42 is attached by a friction-fit. However, it is contemplated that other attachment ways could be used if desired. A hole 43 (FIG. 1) extends through the top plate 21 for top access to adjustable leveling legs 44 (also sometimes called "leveling screws") (FIG. 11). The legs 44 are threaded into the bosses 41, and include a downward foot that engages a top 71 of a vertically adjustable stand 70 (FIG. 12) for supporting the raised floor system. A foot-print-expanding stress-distributing corner bracket 45 (FIG. 11) is Z-shaped in side view, and includes a first flange 46 retained very loosely slipped onto the boss 42. A retainer screw 47 captures the flange 46 on the boss but allows the bracket 45 to slip vertically on the boss 42. The bracket 45 further includes a second perpendicular flange 48 extending from flange 46, and a third flange 49 extending from flange 48. The third flange 49 extends under the tip of the leveling leg 44 and extends to an outboard position that is approximately equal to the edge of the top plate 21. This extends the foot print of the leveling leg 44 outward to the edge of the air grate 20, allowing the air grate 20 to be used on different raised floor systems without misalignment problems with their respective stands 70 (FIG. 12) and the adjacent existing raised floor panels 73.

It is contemplated that the screw 47 can be replaced by various mechanisms to allow movement of the corner bracket 45 during adjustment of the leveling leg 44. For example, it is contemplated that the boss 42 can be elongated vertically, and that the screw 47 can be replaced with a sleeve 47' (FIG. 11A) that slips onto an end of the boss 42. In this arrangement, the sleeve frictionally engages an outer surface of the boss 42 to retain the corner bracket 45 on the boss 42. The sleeve 47' can be made of different materials, including for example metal, plastic, or rubber. Where the sleeve 47' has a relatively low friction on the boss 42, the sleeve 47' can be used to secure the corner bracket 45 tight against a bottom of the top plate 21, but will slide in a manner that allows the corner bracket 45 to slide downward on the boss 42 as the leveling leg 44 is extended during an installation. This allows the corner bracket 45 to be held securely to facilitate manufacture and shipping, but allows for an "automatic" adjustment of the sleeve 47' during installation.

Figure 14:
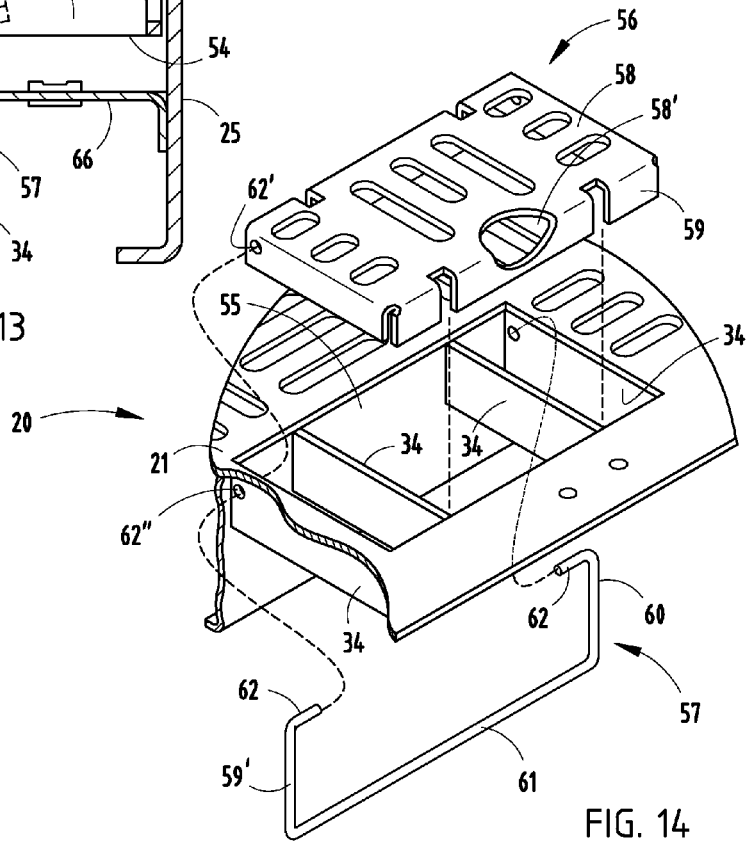
FIG. 14 is an enlarged cross-sectional view showing the handle and pivot member, the handle having its top surface apertured to match a pattern of the apertures in the air grate.

The top plate 21 (FIG. 14) includes a rectangular opening 55 in which a handle 56 is pivotally mounted by a spring wire member 57. The ribs 34 under the opening 55 define a pocket for the handle 56 to rest in when the handle 56 is in a closed flush-to-top-plate position. The handle 56 includes a top panel 58 that aligns with the top plate 21 when the handle 56 is closed. Edge flanges 59 extend from the top panel 58 and stiffen the top panel and also support the handle 56 on the ribs structure thereunder. The spring wire member 57 is generally U-shaped, and includes first and second legs 59-60 connected by a transverse section 61. A pivot-forming section 62 extends from each of the legs 59-60, with each being configured to fit through a hole 62' in the edge flanges 59' and into a mating hole 62" in the adjacent reinforcement rib 34 of the air grate 20. The spring wire member 57 is sufficiently resilient such that the legs 59-60 can be sprung apart for assembly, and when released, they move to the assembled position where they pivotally support the handle 56 in the opening 55. The pivot axis formed by the pivot-forming sections 62 is such that the handle 56 moves to an over-center position when in the raised position (such that the handle stays open and can easily be grasp in opening 58' for lifting the air grate 20 out of a floor system). However, the pivotal support is sufficiently low-friction, such that the handle 56 can be bumped and easily moved to its lowered, flush, closed position. Notably, the top panel 58 is apertured to match the pattern of apertures in the top plate 21 of the air grate 20. This provides an aesthetic match which thus avoids an unsightly blemish in the floor surface at the location of the handle. This is highly desirable to many customers, since a uniform and uninterrupted "clean" appearance of floors is important to many customers and users of raised floor systems.

Figure 3:
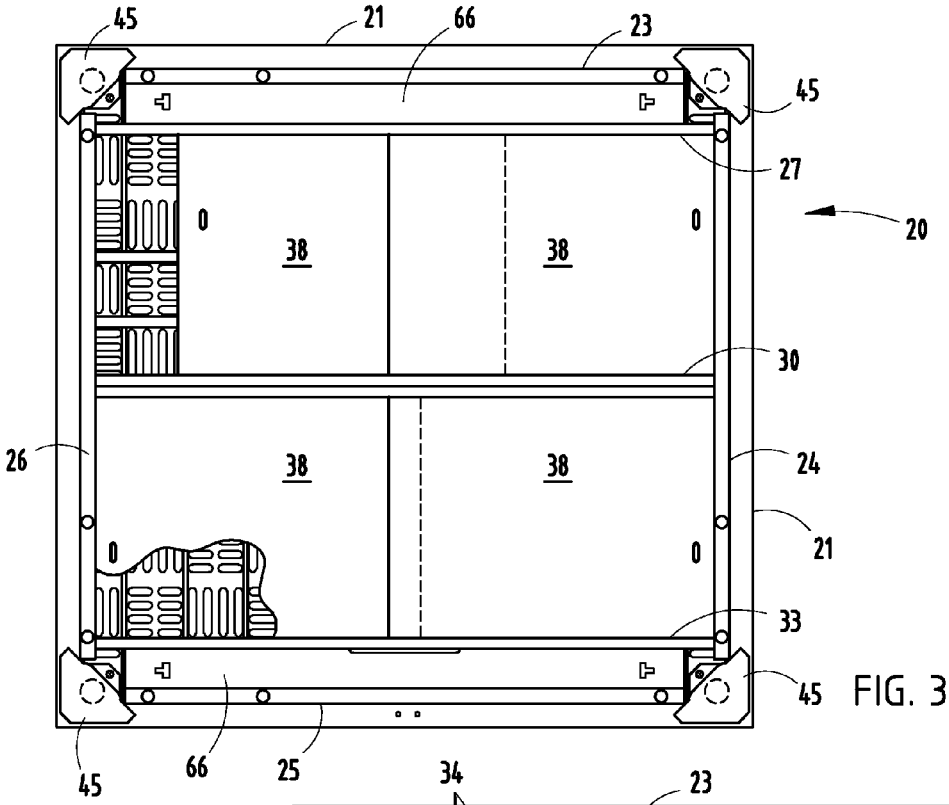
Figure 3A:
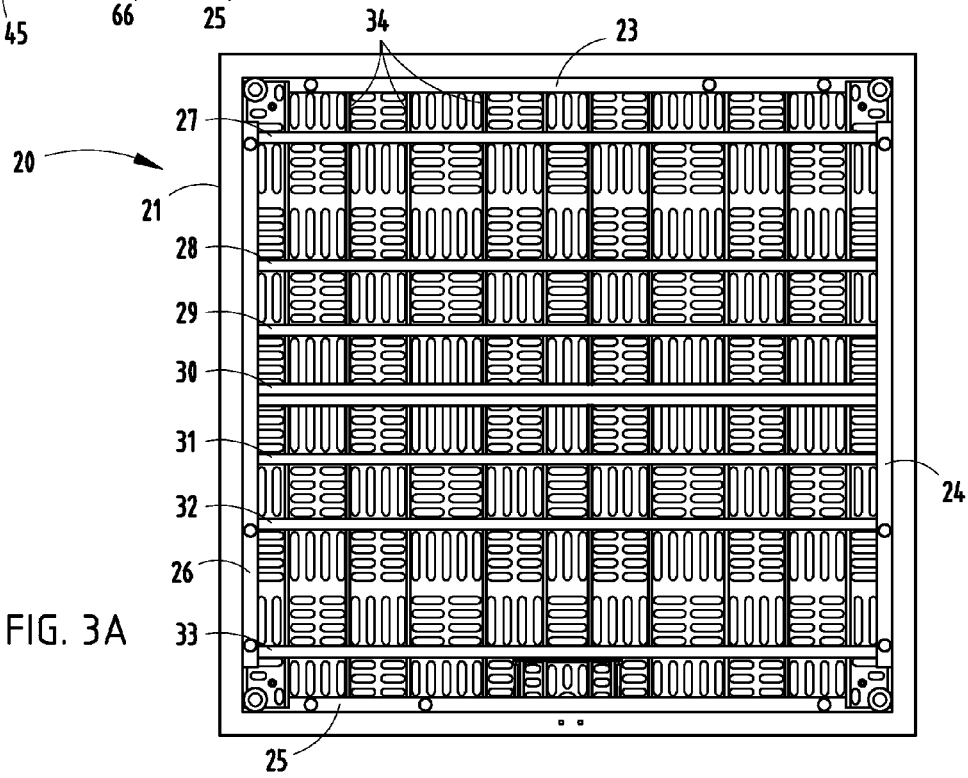
Figure 4:
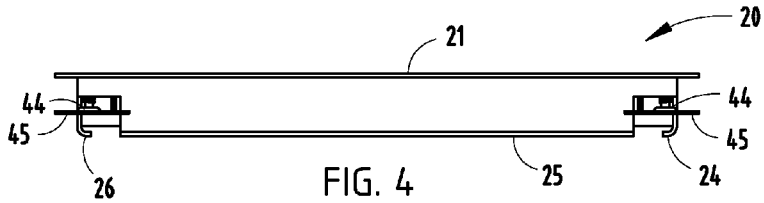
Figure 5:
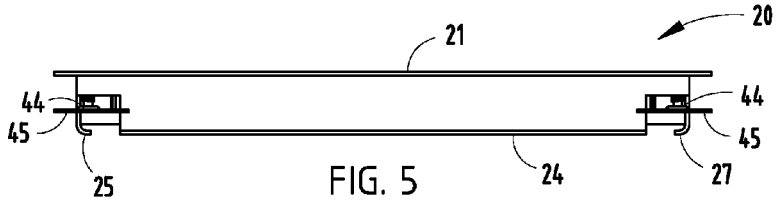
FIG. 5 is a side view of the air grate with dampener panels shown thereon.
Figure 7:
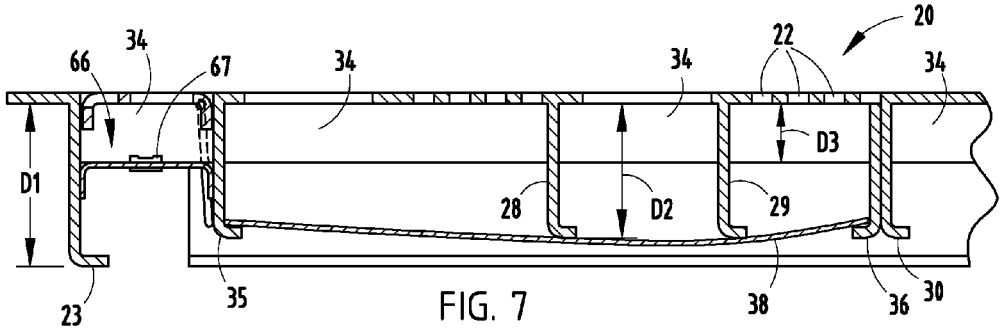
Figure 8:
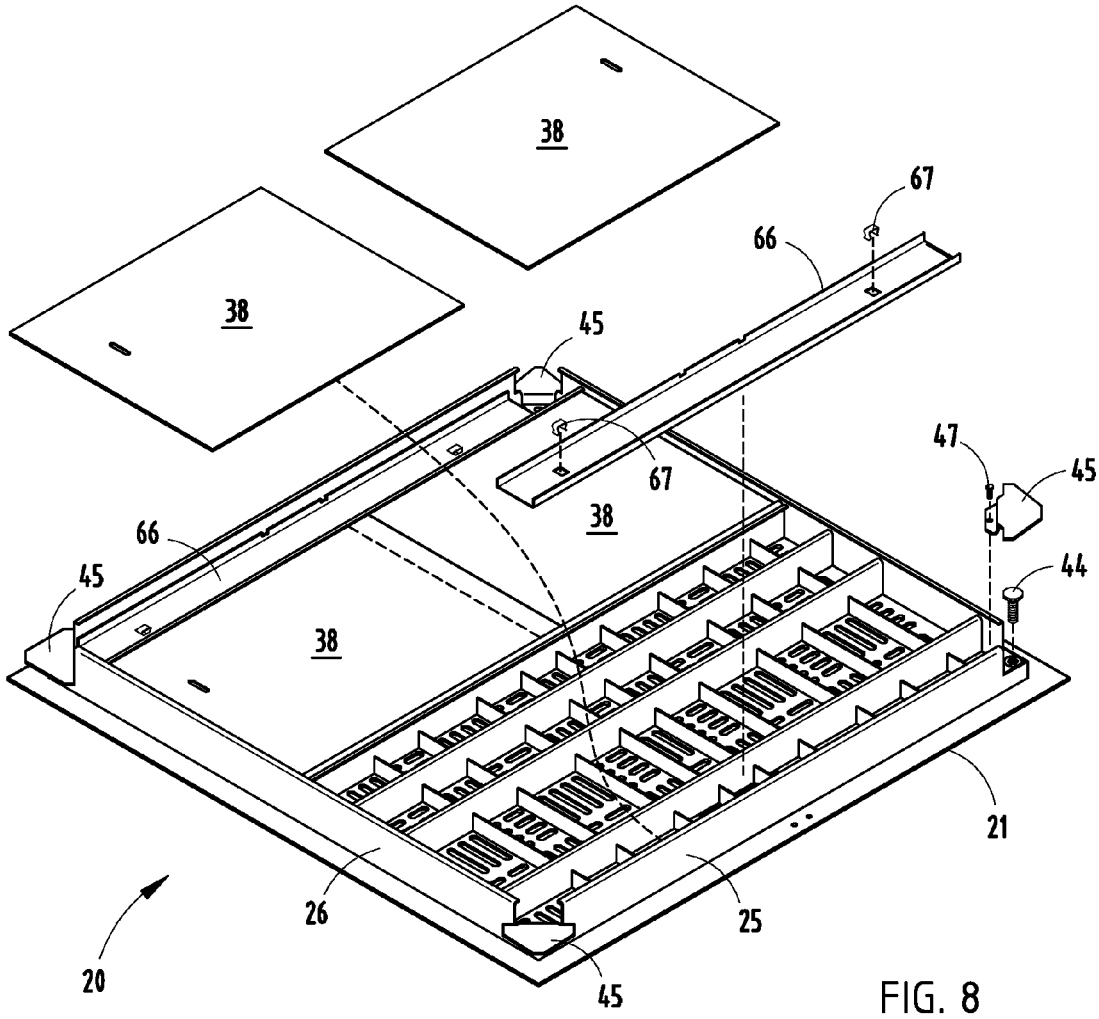
FIGS. 8-9 are perspective bottom and fragmentary bottom views of the air grate showing installation of the dampener skirt and showing the stress-distributing Z-shaped corner bracket.
Figure 9:
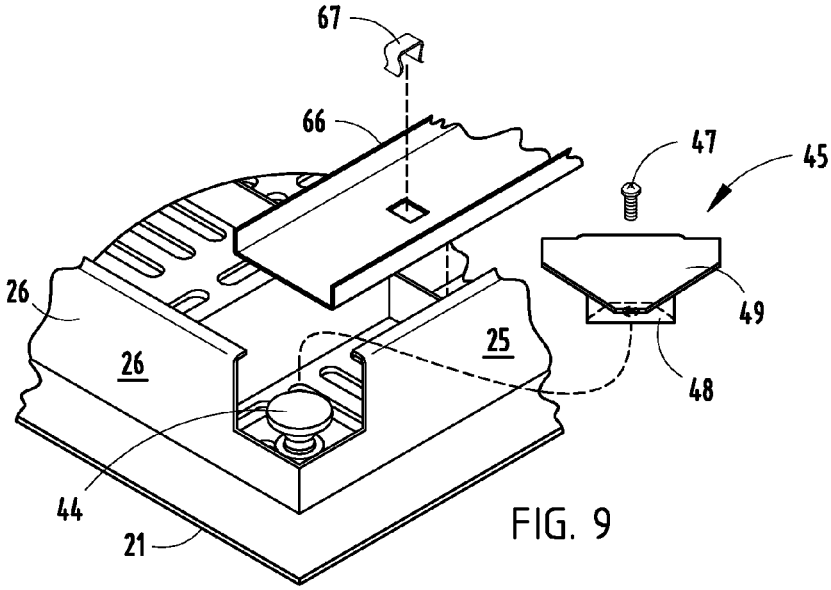
Figure 10:
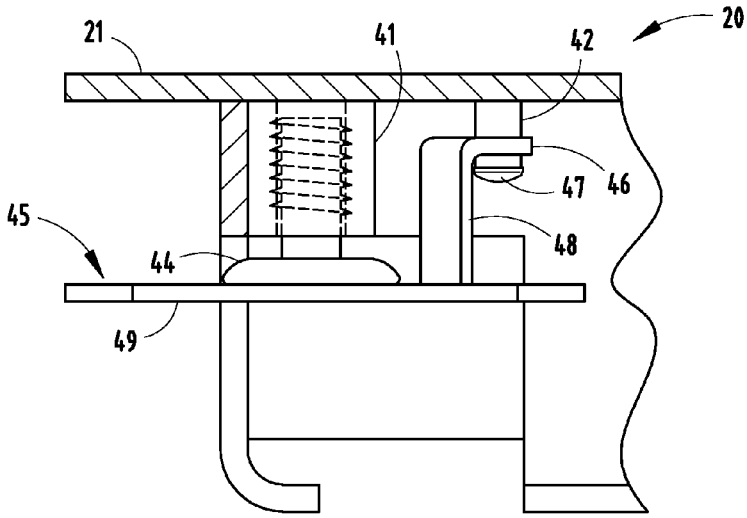
FIG. 10 is a cross-sectional view of the air grate including a showing of the leveling leg and the support-engaging stress-distributing Z-shaped corner bracket.

Dampener skirts 66 (FIGS. 6-7 and FIG. 3) are placed between the perimeter rib 23 and the adjacent reinforcement rib 27, and between the perimeter rib 25 and the adjacent reinforcement rib 33 to block undesired air flow if desired. The illustrated dampener skirts 66 are held in position by spring clips 67 that have a first portion that frictionally clips onto the dampener skirt 66 (such as onto the marginal material at a small hole in the skirt) and have a second portion with barbs that frictionally engage one of the ribs 34 under the skirt.

By the present construction, an air grate is provided that has exceptional weight-bearing strength, yet that can be mated flush to many existing raised floor systems without customization. Dampening can be adjusted easily on-site, and without separate tools, including elimination of one or more of the dampening panels. The leveling legs can be easily and quickly adjusted on-site. The air grate can be easily pulled up from the raised floor system due to the integral handle, yet the overall appearance remains very attractive since the handle does not produce an unsightly blemish in the overall floor appearance.

It is to be understood that variations and modifications can be made on the aforementioned structure without departing from the concepts of the present invention, and further it is to be understood that such concepts are intended to be covered by the following claims unless these claims by their language expressly state otherwise.

The invention claimed is:

1. A universal raised floor panel configured and adapted for use with different raised floor systems having support stands with different floor-panel support surface configurations, but for use without misalignment problems with the respective support stands of the different raised floor systems, comprising:

a top plate and support structure for supporting weight on the top plate, the top plate including corner-forming sections that extend toward a perimeter of the top plate;

leveling legs operably engaging the corner-forming sections for height adjustment; and foot-print-expanding brackets engaging the leveling legs for extending the foot print of the leveling legs nearer to outer edges of the top plate so that the floor panel can be used on different raised floor systems without misalignment problems caused by different support stands, the legs and brackets being assembled and threadably attached to the corner-forming sections to create a unitary assembly that can be manipulated and installed as a single unit, and the legs and brackets including support-stand-engaging bottom surfaces for engaging a top of one of the respective support stands wherein the foot-print-expanding brackets are Z-shaped.

2. The floor panel defined in claim 1, wherein the foot-print-expanding brackets include corner-attached components that are attached to the top plate and support structure and carried therewith as an assembly to facilitate installation, and further wherein the corner-attached components do not include an aperture or fastener for attachment to any of the differently-shaped floor-panel-supporting support stands, but instead are configured to abut same.

3. The floor panel defined in claim 2, wherein the enlarged flange extends to an outer edge of the top plate.

4. The floor panel defined in claim 3, wherein the leveling legs engage one of the corners and an associated one of the brackets.

5. The floor panel defined in claim 1, including a handle operably mounted to the top plate and support structure that is movable between a flush position that is level with the top plate and a raised position allowing the handle to be grasped for lifting the floor panel.

6. The floor panel defined in claim 5, wherein the handle is pivoted to one of the top plate and the support structure.

7. The floor panel defined in claim 6, including a spring clip with legs connected by a transverse member, the legs including pivot-forming sections and being resiliently supported for flexing movement between a first position allowing the pivot-forming sections to be positioned for assembly, and a second position where the pivot-forming sections engage the handle, the support structure including holes for pivotally supporting the handle.

8. A universal raised floor panel configured and adapted for use with different raised floor systems having support stands with different floor-panel support surface configurations, but for use without misalignment problems with the respective support stands of the different raised floor systems, comprising:

a top plate and support structure for forming a part of a raised floor system, the support structure supporting the top plate for supporting weight on the top plate;

a handle;

the top plate including marginal material defining an opening shaped to receive the handle; and the handle having a top plate section shaped to fit within the opening and pivotable between a flush position where its upper surface aligns with an upper surface of the top plate so that at most a small gap exists around a perimeter of the top plate section, and a raised position where the handle can be grasp for lifting the floor panel, the handle including edge flanges extending downward from each edge of the top plate section that stiffen the top plate section and that engage the support structure when in the flush position to maintain the flush position against a weight placed thereon, at least one of the edge flanges including a notch receiving a portion of the support structure.

9. The floor panel of claim 8, including spring clip with legs connected by transverse member, the legs including pivot-forming sections and being resiliently supported for flexing movement between a first position allowing the pivot-forming sections to be positioned during assembly, and a second position where the pivot-forming sections engage the handle, the support structure including holes for pivotally supporting the handle.

10. The floor panel of claim 9, wherein a top surface of the handle includes a pattern replicating the décor in the top plate.

11. The floor panel of claim 10, wherein the handle includes stiffening ribs supporting the top plate section of the handle at least one of the stiffening ribs resting on the support structure when in the flush position.

* * * * *